US009611014B2

(12) United States Patent
Heiler et al.

(10) Patent No.: US 9,611,014 B2
(45) Date of Patent: Apr. 4, 2017

(54) DEVICE FOR LAUNCHING A SUBSURFACE MINING VEHICLE INTO A WATER MASS AND RECOVERING THE SAME FROM THE WATER MASS

(71) Applicant: IHC Holland IE B.V., Sliedrecht (NL)

(72) Inventors: Johan Heiler, Zoersel (BE); Pieter Abraham Lucieer, Rotterdam (NL); Kris De Bruyne, Deurne (BE); Harmen Derk Stoffers, Breda (NL)

(73) Assignee: IHC Holland IE B.V., Sliedrecht (NL)

( * ) Notice: Subject to any disclaimer, the term of this patent is extended or adjusted under 35 U.S.C. 154(b) by 0 days.

(21) Appl. No.: 15/100,714

(22) PCT Filed: Dec. 2, 2014

(86) PCT No.: PCT/EP2014/076205
§ 371 (c)(1),
(2) Date: Jun. 1, 2016

(87) PCT Pub. No.: WO2015/082448
PCT Pub. Date: Jun. 11, 2015

(65) Prior Publication Data

US 2016/0297502 A1 Oct. 13, 2016

(30) Foreign Application Priority Data

Dec. 2, 2013 (NL) ..... 2011882
Apr. 25, 2014 (NL) ..... 2012695

(51) Int. Cl.
*B63B 35/44* (2006.01)
*B63B 27/16* (2006.01)
(Continued)

(52) U.S. Cl.
CPC ..... *B63B 35/44* (2013.01); *B63B 27/16* (2013.01); *B63G 8/001* (2013.01); *E02F 3/8833* (2013.01);
(Continued)

(58) Field of Classification Search
CPC ..... B63B 35/44; B63B 27/16; B63G 8/001; E02F 3/8833; E02F 3/8866; E02F 3/905
See application file for complete search history.

(56) References Cited

U.S. PATENT DOCUMENTS 2,761,571 A * 9/1956 Adams ..... B63B 23/04 114/366
3,890,005 A * 6/1975 Sien ..... B62D 53/02 180/14.1
(Continued)

FOREIGN PATENT DOCUMENTS

WO 2007135399 A1 11/2007

*Primary Examiner* — Stephen Avila
(74) *Attorney, Agent, or Firm* — NLO N.V.; Catherine A. Shultz; Minerva Rivero

(57) ABSTRACT

A device for launching subsurface mining vehicle into a water mass from a docking well of a floating vessel, and/or recovering said vehicle from the water mass is disclosed. The device comprises a docking frame that is hinge mounted to the vessel, and that comprises first mining vehicle engaging means for guiding the mining vehicle along a longitudinal direction of the frame into the water. The docking frame operatively engages with drive means for tilting the frame in a vertical plane between a substantially horizontal mining vehicle docking position and a substantially vertical mining vehicle launching or recovery position. The device further comprises third engaging means for guiding the mining vehicle when the vehicle extends at least partly
(Continued)

underneath a base of the vessel. The device allows lowering or recovering subsurface mining vehicle in a controlled manner.

20 Claims, 15 Drawing Sheets

(51) Int. Cl.

| | |
|---|---|
| ***E02F 7/00*** | (2006.01) |
| ***E21C 50/00*** | (2006.01) |
| ***E02F 3/88*** | (2006.01) |
| ***E02F 3/90*** | (2006.01) |
| ***E02F 9/00*** | (2006.01) |
| *B63B 21/00* | (2006.01) |
| *B63G 8/00* | (2006.01) |

(52) U.S. Cl.

CPC ..... *E02F 3/8866* (2013.01); *E02F 3/905* (2013.01); *E02F 7/005* (2013.01); *E02F 9/003* (2013.01); *E21C 50/00* (2013.01); *B63B 2021/007* (2013.01); *B63B 2027/165* (2013.01); *B63G 2008/007* (2013.01); *B63G 2008/008* (2013.01)

(56) References Cited

U.S. PATENT DOCUMENTS

| | | | | |
|---|---|---|---|---|
| 3,993,011 | A * | 11/1976 | Garland | B63B 27/36 114/210 |
| 8,430,049 | B1 | 4/2013 | Tureaud et al. | |
| 2010/0047040 | A1 | 2/2010 | Burgess et al. | |
| 2012/0132123 | A1* | 5/2012 | Khachaturian | B63B 27/36 114/268 |

* cited by examiner

DEVICE FOR LAUNCHING A SUBSURFACE MINING VEHICLE INTO A WATER MASS AND RECOVERING THE SAME FROM THE WATER MASS

CROSS-REFERENCE TO RELATED APPLICATIONS

This application is the U.S. national phase of International Application No. PCT/EP2014/076205 filed Dec. 2, 2014, and claims priority to Netherlands Patent Application Nos. 2011882 and 2012695 filed Dec. 2, 2013 and Apr. 25, 2014, respectively, the disclosures of which are hereby incorporated in their entirety by reference.

FIELD OF THE INVENTION

The invention relates to a floating vessel used for deep sea mining and more particularly to a docking device for launching a subsurface mining vehicle into a water mass from a docking well of the floating vessel at the beginning a mining operation, or recovering said vehicle from the water mass at the end of a mining operation. The invention further relates to an assembly of such a device and a subsurface mining vehicle attached thereto. The invention finally relates to a method for launching subsurface mining vehicle into a water mass from a docking well of a floating vessel and/or recovering the mining vehicle from the water mass using the device.

BACKGROUND OF THE INVENTION

Deep sea mining involves collecting mineral deposits, such as polymetallic nodules, diamonds, gold, and rare soils from (below) the sea floor at large depths. Polymetallic nodules may for instance comprise nickel, copper, cobalt and manganese nodules. In deep sea mining, the sea floor may be a distance of up to 5000 m and more away from the sea surface, and developing a mining vehicle for collecting the nodules at such depths imposes many challenges.

Deep sea mining vessels need to bring a subsurface mining vehicle to the sea floor and recover the same from the sea floor after termination of a mining operation. Typical vessels thereto comprise some type of launching and docking device that is operated from a docking well. A docking well typically passes through and is enclosed by the vessel hull, and opens to the sea at its bottom side defining a so-called splash zone of the docking well. The docking well may be closable across the bottom by movable gates if desired. It is also possible to launch a mining vehicle over a side edge of the vessel, in which configuration the launching and docking device operates from said side edge of the vessel. The wording 'docking well' in the context of the present application also comprises any side wall of the vessel. A deep sea mining vessel further typically comprises a pumping arrangement for bringing mined mineral deposits from the sea floor to a vessel storage hold through a transport pipe system. A riser string extends from the vessel to the mining vehicle to convey the mined mineral nodules towards the sea surface. A lift system is usually operational in raising and launching the riser string.

WO 2007/135399 A1 discloses a device for launching equipment from a vessel. Typical equipment includes Christmas trees for coupling to a seabed wellhead, BOP stacks, intervention systems, and subsea processing equipment such as pumps, and manifolds. The prior art device comprises a docking frame or cradle, that is located on deck of a vessel and can be translated over rails provided on deck. The cradle is hinge mounted to the vessel and can be tilted between a substantially horizontal equipment docking position and a substantially vertical launching position. The cradle comprises a carriage for guiding the equipment along a longitudinal direction of the cradle.

U.S. Pat. No. 8,430,049 B1 discloses a launch and recovery system for a vehicle. A frame is tilted with respect to a vessels deck, such that a rear end of the frame is below the water surface. The frame carries an intercepting vehicle that is lowered into the water by towing out a line with the aid of a winch. The vehicle to be launched or retrieved is attached to the intercepting vehicle.

In launching subsurface mining vehicle, the maximum environmental circumstances are often limited to certain wave heights, and considerable time is lost while waiting for a weather window for deploying or recovering the vehicle. Further, most damages to subsea mining vehicle occur during launching and recovery. Given the size, complexity and cost of a mining vehicle, this is unacceptable.

The above described disadvantages occur to an even higher extent in launching and recovering subsurface mining vehicle. Such a deep sea mining vehicle indeed is configured to move across a sea floor when collecting nodules and the ratio of the vehicle's submerged weight to its sea floor contact surface should preferably be lower than 6,90 kPa (or about 690 kg/m$^2$). A deep sea mining vehicle therefore has a relatively low weight combined with a relatively large contact surface. This makes it difficult to control the vehicle during launch when suddenly contacting a moving mass of water, or to grab the vehicle during a recovery operation. The risk for collision with parts of the vessel or other structures is high.

Therefore, an aim of the present invention is to provide a device and method for launching subsurface mining vehicle into a water mass and/or recovering the vehicle from the water mass in a more controlled manner.

SUMMARY OF THE INVENTION

The present invention thereto provides a launching and/or recovery device comprising a docking frame, located at a side of the docking well and hinge mounted to the vessel, which docking frame comprises first mining vehicle engaging means for guiding the mining vehicle along a longitudinal direction of the frame into the water, and which docking frame operatively engages with drive means for tilting the frame in a vertical plane between a substantially horizontal mining vehicle docking position and a substantially vertical mining vehicle launching or recovery position; the device further comprising third engaging means for guiding the mining vehicle when the vehicle extends at least partly underneath a base of the vessel.

The known launching devices lower a mining vehicle through a docking well with the vehicle in a substantially horizontal position, which corresponds to the position of the vehicle when mining on a seafloor. The present invention allows lowering of a mining vehicle in a substantially vertical position and/or recovery of a mining vehicle in a substantially vertical position. This reduces the drag forces exerted by the water on the vehicle and provides a better control over the launching and recovery operation. By engaging and fixing the vehicle in the engaging means of the frame, it becomes possible to guide the mining vehicle in a controlled manner through the splash zone of the docking well, which generally is a relatively narrow space. This is achieved by establishing a substantially rigid connection between the vehicle and the vessel during a substantial part of the launching and/or recovery operation.

The wording 'substantially' in the context of the present application refers to at least 90% of the indicated quantity, more preferably at least 95%.

A device in accordance with the invention allows to lower or recover a mining vehicle vertically in a narrow space, like a docking well, in a well controlled manner. This increases mining time, since the launch and recovery of a piece of mining equipment such as a mining vehicle can now also be carried out in harsh weather conditions.

The invention thus also relates to a method for launching subsurface mining vehicle into a water mass from a docking well of a floating vessel. The method comprises providing a device in accordance with the invention, connecting a mining vehicle to the docking frame in a substantially horizontal docking position of the frame, tilting the frame in a vertical plane between the docking position and a substantially vertical mining vehicle launching position, and lowering the mining vehicle into the water while guiding the mining vehicle along a longitudinal direction of the frame, whereby the mining vehicle is guided by third engaging means when the vehicle extends at least partly underneath a base of the vessel.

The invention further relates to a method for recovery of a subsurface mining vehicle from a water mass into a docking well of a floating vessel, the method comprising providing a device in accordance with the invention, bringing a mining vehicle in proximity of the vessel, catching and guiding the mining vehicle by the third engaging means when the vehicle extends at least partly underneath a base of the vessel, providing the docking frame in a substantially vertical position, engaging the vehicle and the docking frame, pulling the vehicle upwards out of the water mass while guiding the vehicle along a longitudinal direction of the frame, and tilting the frame in a vertical plane between the substantially vertical mining vehicle recovery position to a substantially horizontal docking position.

When arriving above the seafloor, a lifting frame attached to the vehicle will allow the vehicle to turn on its own center of gravity. It is preferably placed first with the back on the seafloor in order to prevent damage to a collector mounted at the front of the mining vehicle.

An embodiment of the invention provides a device wherein the docking well comprises second engaging means for guiding the mining vehicle, the second engaging means connecting to the first engagement means when the frame is in the substantially vertical mining vehicle launching position. This embodiment allows guiding the mining vehicle further in a substantially vertical launching position along side walls of the docking well in the direction of the water. The second engaging means take over the function of the first engagement means. This embodiment also allows guiding the mining vehicle further in a substantially vertical recovery position along side walls of the docking well and out of the water. The first engaging means then take over the function of the second engagement means. The present embodiment is useful when the docking well is relatively deep.

A useful embodiment relates to a device wherein the second engaging means extend along a side wall of the docking well.

In a practical embodiment of the device according to the invention, the first and second engaging means comprise guiding rails, adapted to cooperate with guiding brackets provided on the mining vehicle.

The mining vehicle may be guided in a substantially vertical launching position along side walls of the docking well until it extends at least partly underneath a base of the vessel. Since the second guiding means may only extend up to the base of the vessel, a mining vehicle in this position may no longer be supported completely by the second guiding means, and may show the tendency of being carried away by current. According to the invention therefore, a device is provided that comprises third engaging means for guiding the mining vehicle when the vehicle extends at least partly underneath a base of the vessel. The third engaging means are also useful when recovering the mining vehicle from a water mass. The vehicle will then first be engaged by the third engaging means when the vehicle extends at least partly underneath the vessel's base. This allows preventing excessive movement of the vehicle. The vehicle is then brought upwards to the second and first engaging means to finally be docked.

Another embodiment provides a device wherein the third engaging means are translatable in a vertical direction along the docking well. This will allow guiding a mining vehicle over a vertical distance before releasing the vehicle in the water and/or recovering the vehicle from the water. The device and method in this embodiment provide a rigid connection between the vessel and a mining vehicle at all times during launching and/or during recovery, at least from the moment the third engaging means still engage the vehicle during launching, or the third engaging means engage the vehicle during a recovery operation from the mass of water.

A practical embodiment of the device according to the invention is characterized in that the third engaging means comprise a plurality of guiding arms that extend in the docking well in a substantially horizontal direction, and are translatable in said horizontal direction. The guiding arms can be actuated by hydraulic means for instance. In another embodiment the third engaging means comprise pads adapted to engage with the vehicle, for instance with track assemblies provided on the vehicle.

In order to allow launch and recovery procedures in harsh conditions, a specific sequence may be followed. A mining vehicle is upended in vertical position by means of the upending docking frame, and lowered down controllably by the first and second engaging means through the splash zone in a vessels docking well. The vehicle is lowered down vertically which reduces its frontal surface in the water mass. Before the vehicle will be released, it may be guided further by third engaging means in the form of guiding arms for instance that engage the vehicle. The vehicle will be lowered further so it is substantially free from the first and second engaging means. The guiding arms then open smoothly in order to let the vehicle find its ideal free-hanging position in the current. Finally the vehicle will be lowered down further by a lifting rope.

In a recovery operation the sequence is reversed. A mining vehicle is first brought from the sea floor upwards to the vicinity of the vessel by for instance pulling on a lifting rope. The third engaging means are then operated in order to grab the vehicle. This can in an embodiment be performed by opening the guiding arms and let the vehicle enter the area between the opened guiding arms. The guiding arms then close gradually to grab at least a part of the vehicle, in particular tracks of the vehicle, such that the vehicle may find its ideal free-hanging position in the current. The vehicle is then brought upwards by translating the third engaging means in an upward direction until the vehicle engages the second engaging means. The vehicle is then further brought upwards through the splash zone while being engaged with the second engaging means until it engages the first engagement means. These movements are well controlled since engagement with the first and second engagement means provide a rigid connection between vehicle and vessel. When the vehicle is at work deck height, it is finally turned over from a substantially vertical position to a substantially horizontal position by means of the docking frame.

In an embodiment of the device according to the invention, the docking frame comprises a pair of parallel docking legs.

Another embodiment of the invention provides a device wherein the mining vehicle engaging means comprise guiding rails, adapted to cooperate with guiding brackets extending from a mining vehicle.

Yet another embodiment of the invention provides a device comprising locking means for securing the frame in an angular position.

The invention in another embodiment provides a device wherein the drive means comprise hydraulic drive means mounted on the vessel and mechanically linked to the frame.

A further aspect of the invention relates to an assembly of a device according to the invention and a subsurface mining vehicle attached thereto.

In an embodiment of the assembly, the mining vehicle is adapted to mine an underwater bottom in a substantially horizontal position, and the mining vehicle connects with the docking frame in its docking position in the substantially horizontal position of the mining vehicle.

In another embodiment of the assembly, the mining vehicle is adapted to mine an underwater bottom in a substantially horizontal position, and the mining vehicle connects to the docking frame in its launching position in a substantially vertical position of the mining vehicle.

Another aspect of the invention relates to a method for launching subsurface mining vehicle into a water mass from a docking well of a floating vessel, the method comprising providing a device in accordance with the invention, connect a mining vehicle to the docking frame in its substantially horizontal docking position, tilt the frame in a vertical plane between the docking position and a substantially vertical mining vehicle launching position, and lower the mining vehicle while guiding the mining vehicle along a longitudinal direction of the frame into the water.

In another embodiment of the invented method the mining vehicle is guided along second engaging means provided in the docking well, the second engaging means connecting to the first engagement means when the frame is in the substantially vertical mining vehicle launching position.

In yet another embodiment of the invented method the mining vehicle is guided along second engaging means that extend along a side wall of the docking well.

A preferred embodiment of the invention provides a method wherein the mining vehicle is guided by guiding brackets provided on the mining vehicle that engage with first and second engaging means comprising guiding rails.

According to the invented method, the mining vehicle is guided by third engaging means when the vehicle extends at least partly underneath a base of the vessel.

The third engaging means in an embodiment of the invention are translated in a vertical direction along the docking well.

In a useful embodiment of the method in accordance with the invention the third engaging means comprise a plurality of arms that extend in the docking well in a substantially horizontal direction, and the arms are translated in said horizontal direction to engage the mining vehicle.

BRIEF DESCRIPTION OF THE DRAWINGS

The invention will now be elucidated in more detail with reference to the accompanying figures, without otherwise being limited thereto. In the figures.

DETAILED DESCRIPTION

Figure 1:
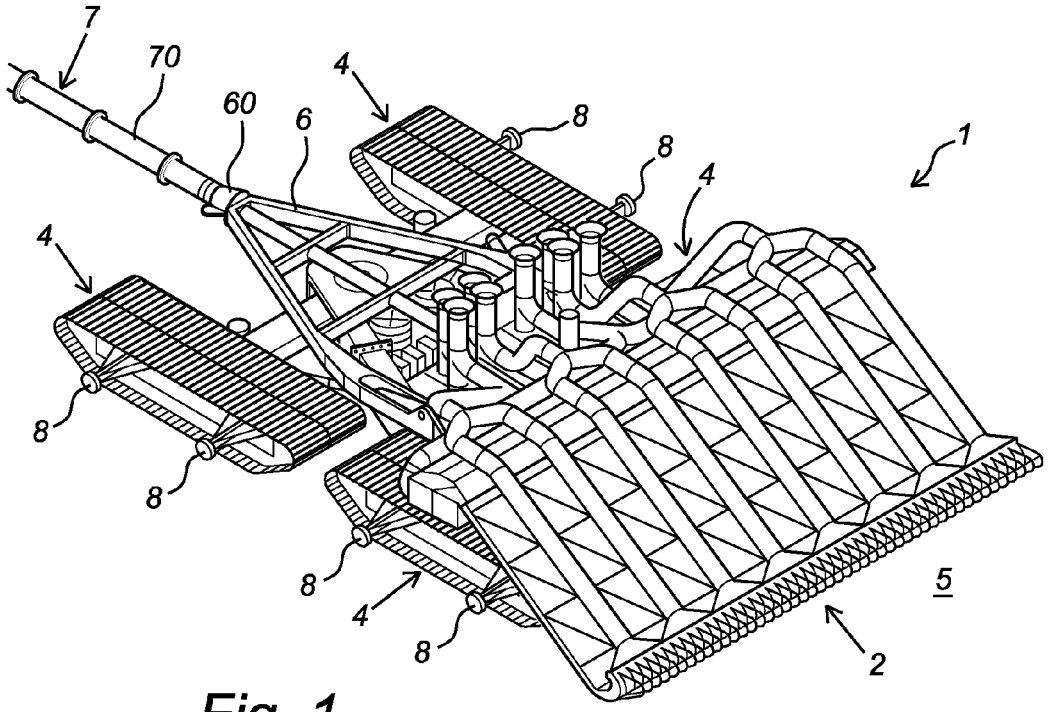
FIG. 1 is a perspective view of an embodiment of a subsurface mining vehicle that is launchable and recoverable by a docking device of the present invention.

A general arrangement of an embodiment of a mining vehicle 1 that is readily launchable and recoverable by a docking device on a floating vessel is shown in FIG. 1. The mining vehicle 1 comprises on a front side thereof a collector 2. The "hydraulic" collector 2 of the embodiment shown is only one example of a suitable collector and other collectors may be used as well within the scope of the invention. The vehicle 1 further comprises a load-bearing structure provided with propelling means in the form of four track assemblies 4. A pair of track assemblies 4 moves independently from each other at one side of the vehicle 1, while another pair of track assemblies 4 moves at an opposite side of the vehicle 1. Rotating the track assemblies 4 will advance the vehicle 1 over a sea bed 5.

The load-bearing structure further accommodates pumps, electrical vehicle, hydraulic vehicle and the like, and a hinged lifting frame 6 that connects the vehicle 1 to an interconnection hose assembly 7 of a riser 8. Four vehicle guiding brackets 8 are mounted on each side of the vehicle 1 and are intended to guide the vehicle 1 through guiding rails provided in a docking device on a vessel during deployment. The brackets 8 are mounted on the foundations of the track assemblies 4, two per track assembly.

Figure 2:
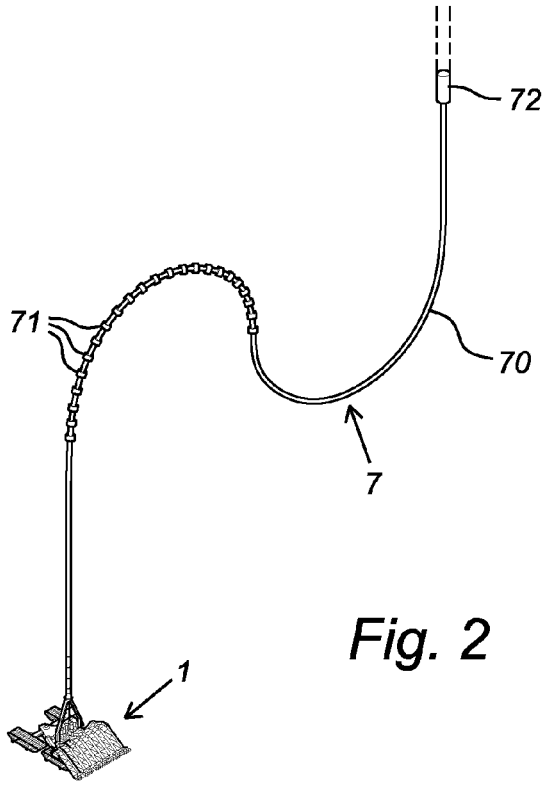
FIG. 2 is a perspective view of an assembly of the subsurface mining vehicle of FIG. 1 and a flexible riser to which it is attached.

The interconnection hose assembly 7 to which the vehicle 1 connects is schematically shown in FIG. 2. The assembly 7 comprises a flexible submarine hose 70 that is adapted to transport mineral nodules collected by the vehicle 1 to a rigid riser 72. The flexible hose 70 itself comprises a plurality of hose units of 10-15 m long for instance, interconnected by bolted flanges. When the mining vehicle 1 is not operational, the complete hose 70 is preferably stored on a reel provided on the floating vessel.

In an embodiment, a number of buoyancy elements or blocks 71 is divided over one or more hoses 70, over an equivalent length of about 50 m for instance. The buoyancy blocks 71 generate an upward force in a part of the hose 70 to create an S-shape which decouples both vertical movements of the end of the riser 72 (due to heave for instance)

as well as horizontal movements of the vehicle 1. The total length of the flexible hose 70 may be chosen within a large range and may for instance be around 150 m.

Figure 3:
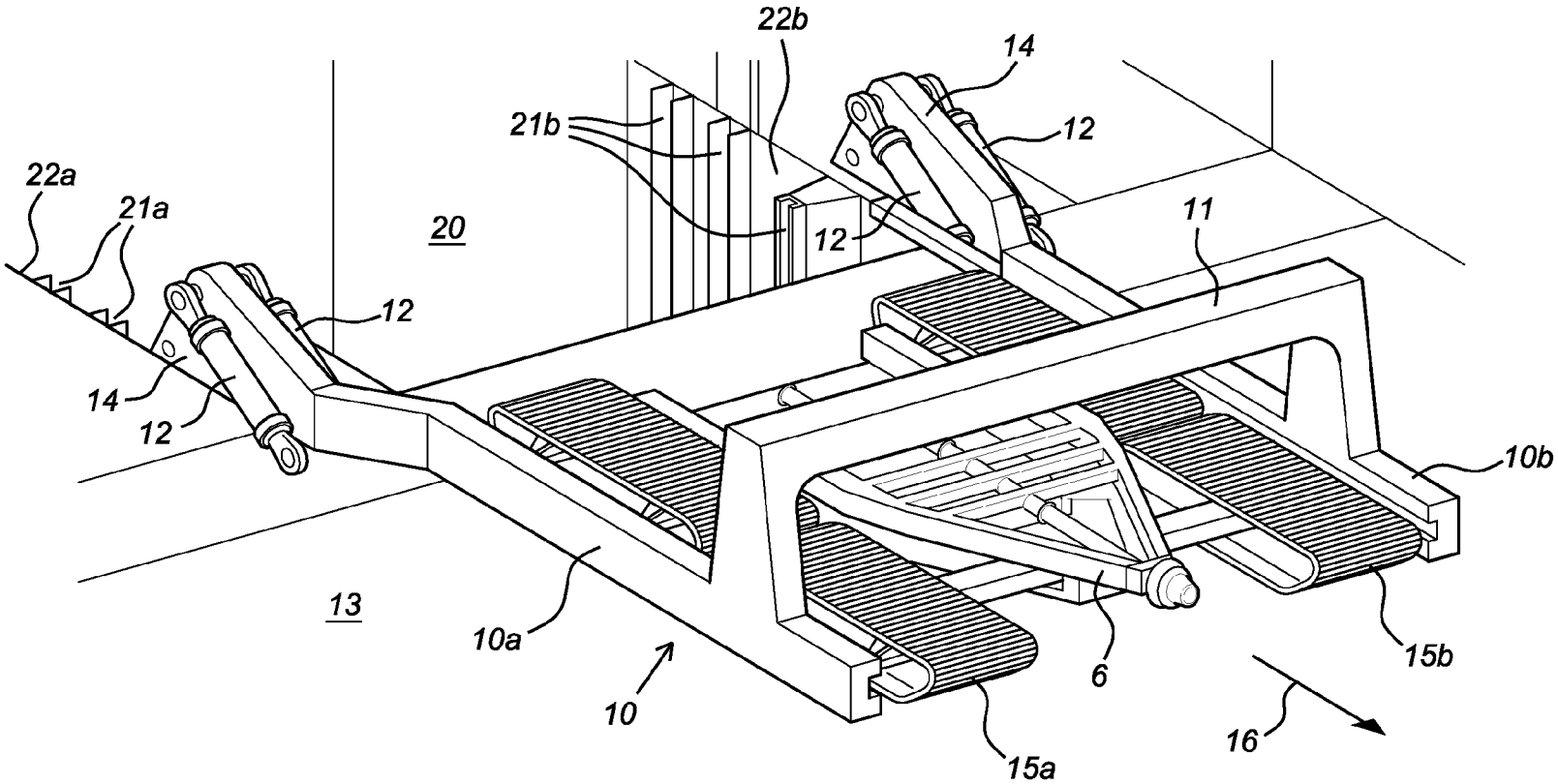
FIG. 3 is a perspective view of an embodiment of the docking device for launching and recovering subsurface mining vehicle in accordance with the invention.

An embodiment of a docking device in accordance with the invention is schematically shown in FIG. 3. The docking device comprises an upending docking frame 10 comprising two longitudinal legs (10*a*, 10*b*), one transversal beam 11 that connects the legs (10*a*, 10*b*) at an aft side of the frame 10, and four hydraulic cylinders 12, adapted to rotate the frame 10 around a substantially horizontal axis, i.e. an axis running about parallel to a work deck 13 of a mining vessel. The docking frame 10 operatively engages with drive means in the form of hydraulic cylinders 12 for tilting the frame 10 in a vertical plane between a substantially horizontal mining vehicle docking position and a substantially vertical mining vehicle launching position, as shown on the right and left side of FIG. 4 respectively. The frame 10 is thereto connected to work deck 13 by hinges 14 that provide pivot points for the frame 10.

The legs (10*a*, 10*b*) are provided with first engaging means in the form of guiding rails (15*a*, 15*b*). In guiding rails (15*a*, 15*b*) eight vehicle guiding brackets 8 (four on each side) can slide in a longitudinal direction 16 of the frame. When a vehicle 1 is skidded into a horizontal docking position on the work deck 13 (the position shown in FIG. 3) the upending frame 10 can be lowered on top of the vehicle 1. The collector 2 of the vehicle faces a docking well 20 provided in the hull of the vessel (the collector is not shown in FIG. 3 for clarity reasons). The guiding rails (15*a*, 15*b*) are provided with openings in a bottom part at the location of the vehicle guiding brackets 8. When the guiding brackets 8 are received in the openings in the guiding rails (15*a*, 15*b*), the vehicle 1 is moved slightly forward, which slides the brackets 8 further in the guiding rails (15*a*, 15*b*). The vehicle 1 is subsequently locked on each side of the upending frame 10 by locking cylinders (not shown). The frame 10 is now ready to be up-ended in order to launch the vehicle 1.

The pivot points provided by hinges 14 are positioned in such a way that the guiding rails (15*a*, 15*b*) of the frame 10 align with second engaging means in the form of guiding rails (21*a*, 21*b*) that extend inside the docking well 20 along opposing side walls (22*a*, 22*b*) thereof, when the frame 10 is in its upended (vertical) position.

The device in accordance with the invention comprises an upending frame 10, to tilt the vehicle 1 to a substantially vertical position; a hoisting or lowering system 30, which connects to lifting cables of an interconnection hose assembly. This preferably includes means to store the lifting cables when hoisted on deck; a flexible hose storage reel, to store the hose when hoisted on deck; a buoyancy dispensing system and manipulators to attach and detach buoyancy to the interconnection hose assembly if desired; a system that guides the vehicle 1 both in the upending frame 10 and down through the docking well 20 until the vehicle is 1 below the vessel baseline. This system comprises the first, second and third engaging means (15*a*, 15*b*, 21*a*, 21*b*, 25); and provisions to disconnect the interconnection hose from its hoisting system 30 and to connect it to a bottom end of the riser 72.

Figure 5:
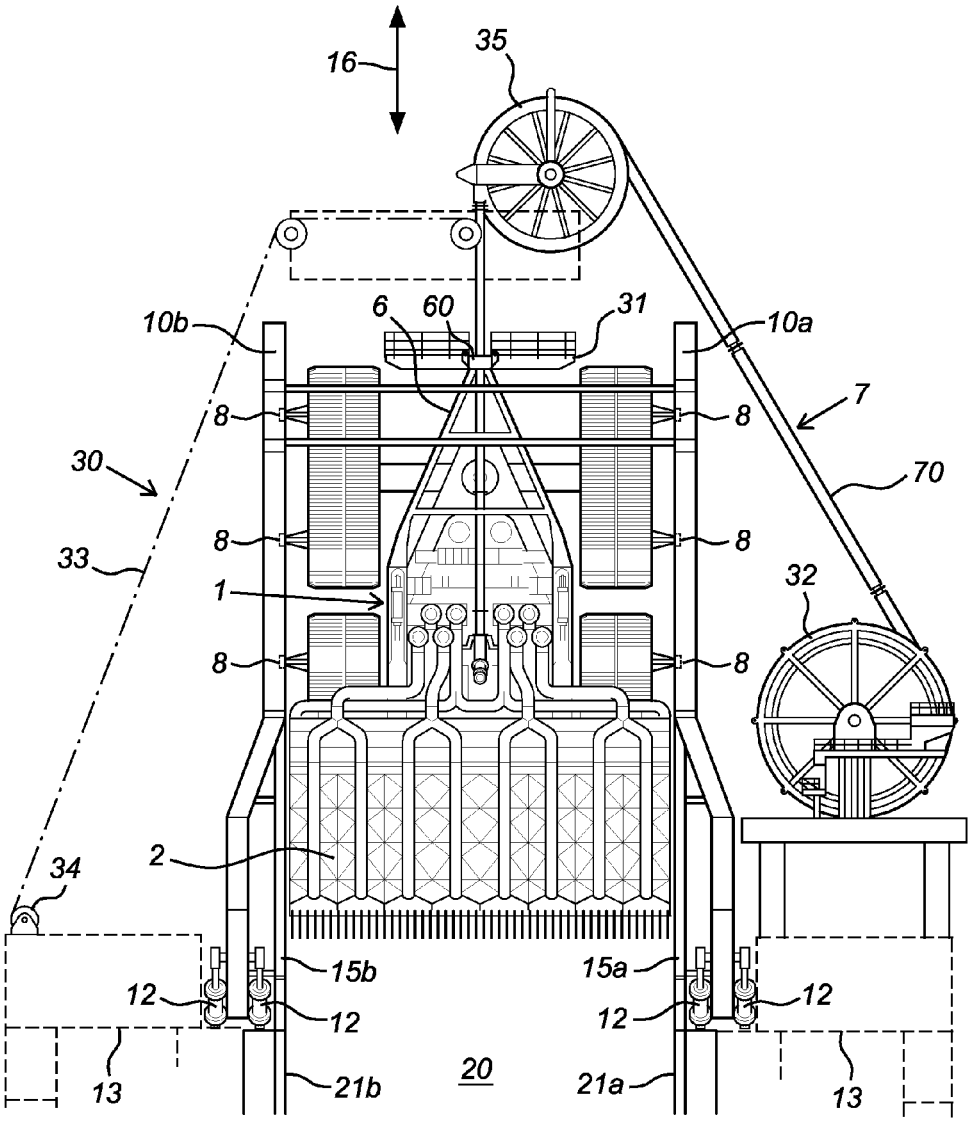
FIG. 5 is a cross-sectional view of a hoisting arrangement that is part of the docking device according to an embodiment of the invention.

A vehicle hoisting system 30 is adapted to carry the weight of a mining vehicle 1 and the interconnection hose assembly 7 until this weight is handed over to the riser 72. It is dimensioned for the maximal static and dynamic loads that may occur during launch and recovery. FIG. 5 shows a cross section of a vehicle lifting arrangement 30 according to an embodiment of the invention.

The interconnection hose assembly 7 may comprise two steel wires that take the forces, and a flexible hose 70 to transport the slurry. As soon as the vehicle 1 is in an upright position, the hose assembly 7 is unrolled from its storage reel 32, led over another reel 33 and connected to the vehicle lifting frame 6. This may be a manual action, for which a connection platform 31 may be provided. As soon as the hose assembly 7 is secured, lifting wires 33 that connect a lifting winch 34 to an upper end of the lifting frame 6 of vehicle 1 are tensioned, and the locking pins of the upending frame 10 are released. The vehicle 1 is then suspended in the lifting wires 33.

When the vehicle 1 is suspended from both winches 33, it will be lowered along with the interconnection hose system 7 through the docking well 20 while being guided by the guiding rails (15*a*, 15*b*) and docking well guiding rails (21*a*, 21*b*) until it is well below the vessel base and ready to be released by the guiding rails (21*a*, 21*b*).

The vehicle can now be lowered over the total length of the interconnection assembly 7, which may be as long as 150 m. At this point the weight may be transferred from the hoisting system 30 to a travelling crane, provided at main deck height of the vessel.

When the frame 10 is upright, the guiding rails (15*a*, 15*b*) of the upending frame 10 are aligned with the guiding rails (21*a*, 21*b*) installed on both sides of the docking well 20. The vehicle guiding brackets 8 slide in these guiding rails during downward movement. As such, and as long as the vehicle is in the docking well 20 and the brackets 8 are inside the guiding rails (21*a*, 21*b*), longitudinal and transversal movements as well as rotations of the vehicle 1 relative to the vessel are substantially prevented.

In case of recovery of a vehicle 1, the guiding brackets 8 of the vehicle 1 will most probably not be perfectly aligned with the guiding rails (21*a*, 21*b*) inside the docking well 20. The lower parts of these guiding rails (21*a*, 21*b*) therefore have a conical shape in a preferred embodiment.

The vehicle 1 in the embodiment shown is equipped with eight guiding brackets 8. The guiding brackets 8 on the vehicle 1 will transfer forces due to waves and current in the docking well 20 onto the vessel. As the vehicle 1 is lowered below the vessel baseline, it becomes subject to the surface current. At first the eight guiding brackets 8 take all forces. As soon as the forward track assembly 4 is lowered below the vessel base, only four brackets 8 remain in the guiding rails (21*a*, 21*b*). The vehicle 1 remains mechanically guided as long as at least four brackets 8 are inside the docking well guiding rails (21*a*, 21*b*), and no or only limited movement is possible.

A critical moment during deployment of the vehicle 1 is the point where the third and fourth guiding brackets 8 tend to exit the guiding rails (21*a*, 21*b*). Third engaging means in the form of additional guiding arms may therefore be used in a preferred embodiment to control the movements of the vehicle when released from the guiding system (21*a*, 21*b*). This will prevent peak loads on the structures as well as prevent the vehicle from colliding with the vessel. Four of such guiding arms 25 are installed in a suitable embodiment. These arms 25 can move vertically as well as horizontally. They will guide the vehicle 1 while it is being lowered to prevent movement, and will be gradually released when the vehicle 1 is well below the vessel base.

Aft guiding arms may be used having a relatively long stroke of between 2000 and 6000 m, for instance 4200 mm, while guiding elements in the front have a smaller stroke of between 400 and 1200 mm, for instance 800 mm. Each guiding arm consists of a large pad on an extendable arm which can be moved up and down in the docking well by a rack and pinion mechanism. The pads are fixated onto the extendable arms by means of a ball joint. This gives them the possibility to rotate freely. The pads are mounted in way of the track assemblies and preferably engage the track assemblies 4.

The guiding elements (15*a*, 15*b*, 21*a*, 21*b*, 25) preferably do not hoist the vehicle 1 while it goes down the docking well 20, but merely guide it. The weight of the vehicle 1 is preferably suspended from the lifting cables 33.

The mining vehicle comprises cylinders, actuators and drives to operate it, as well as sensors, indicators and limit switches. In a preferred embodiment, any movement or action is remotely operated. The vehicle may be centrally controlled, for instance by a redundant PLC based automation system. The operations may be semi-automatic, implying that each action is initiated by and checked by an operator. The system is preferably adapted to ensure that operator actions that may lead to unsafe situations, potential damage or collision of the vehicle may be blocked by the system. Operations on deck or on handling platforms may be performed by one or more operators standing near the vehicle using radio remote controls. All operations that involve control of submerged parts (like the guiding arms 25 for instance) may also be executed from a control cabin located on deck with a clear view on the docking well and hoisting arrangement. The control system preferably also provides the operator with the necessary feedback and status information from sensors, camera images, etc. to ensure a swift and safe operation.

The different steps for launching a mining vehicle 1 may be as follows (see FIGS. 6A to 6M). As the sequences for launch and recovery are very similar (though inverse) only the launching action will be described below in detail and in accordance with one non-limiting embodiment.

Figure 4:
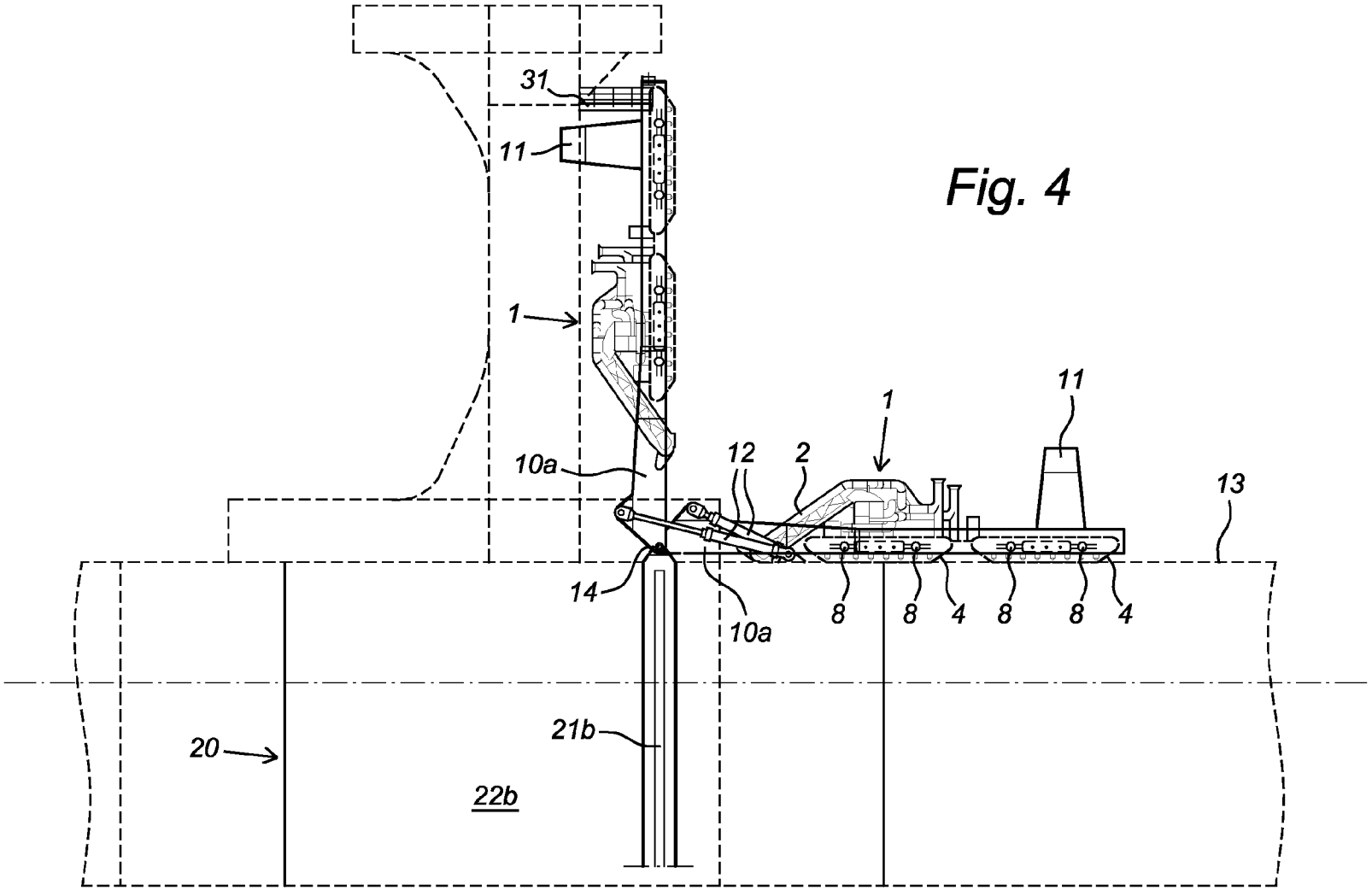
FIG. 4 is a side view of the docking device of FIG. 3 comprising the mining vehicle of FIG. 1 in a horizontal and a vertical position.
Figure 6A:
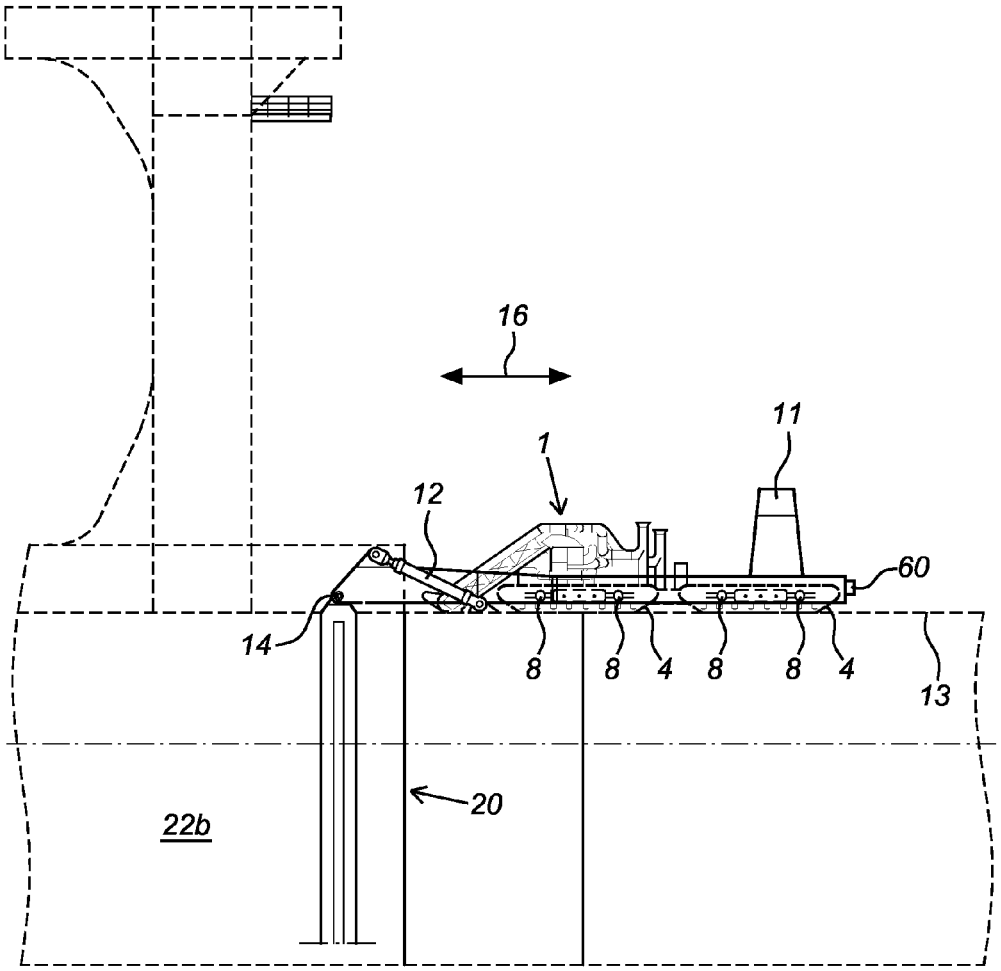
FIG. 6A to 6M schematically show different steps in launching a vehicle according to an embodiment of the invented method.
Figure 6B:
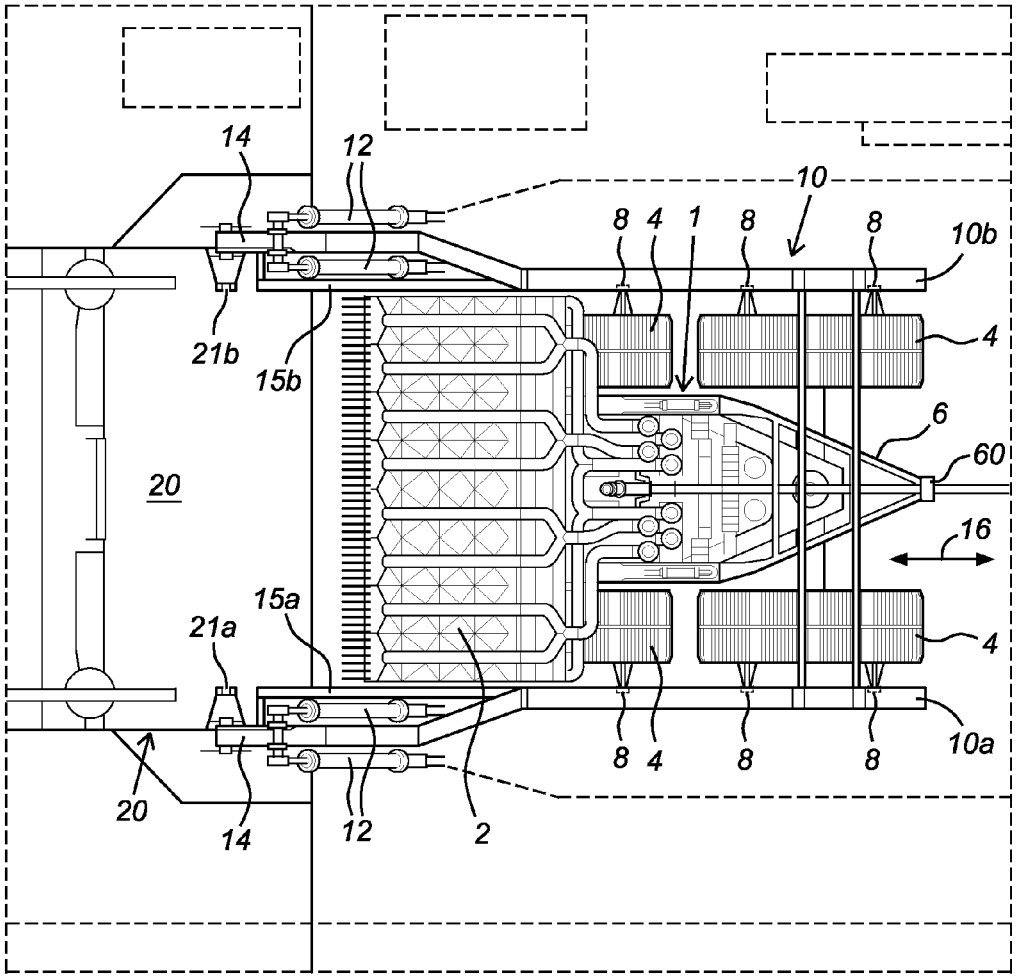
Figure 6C:
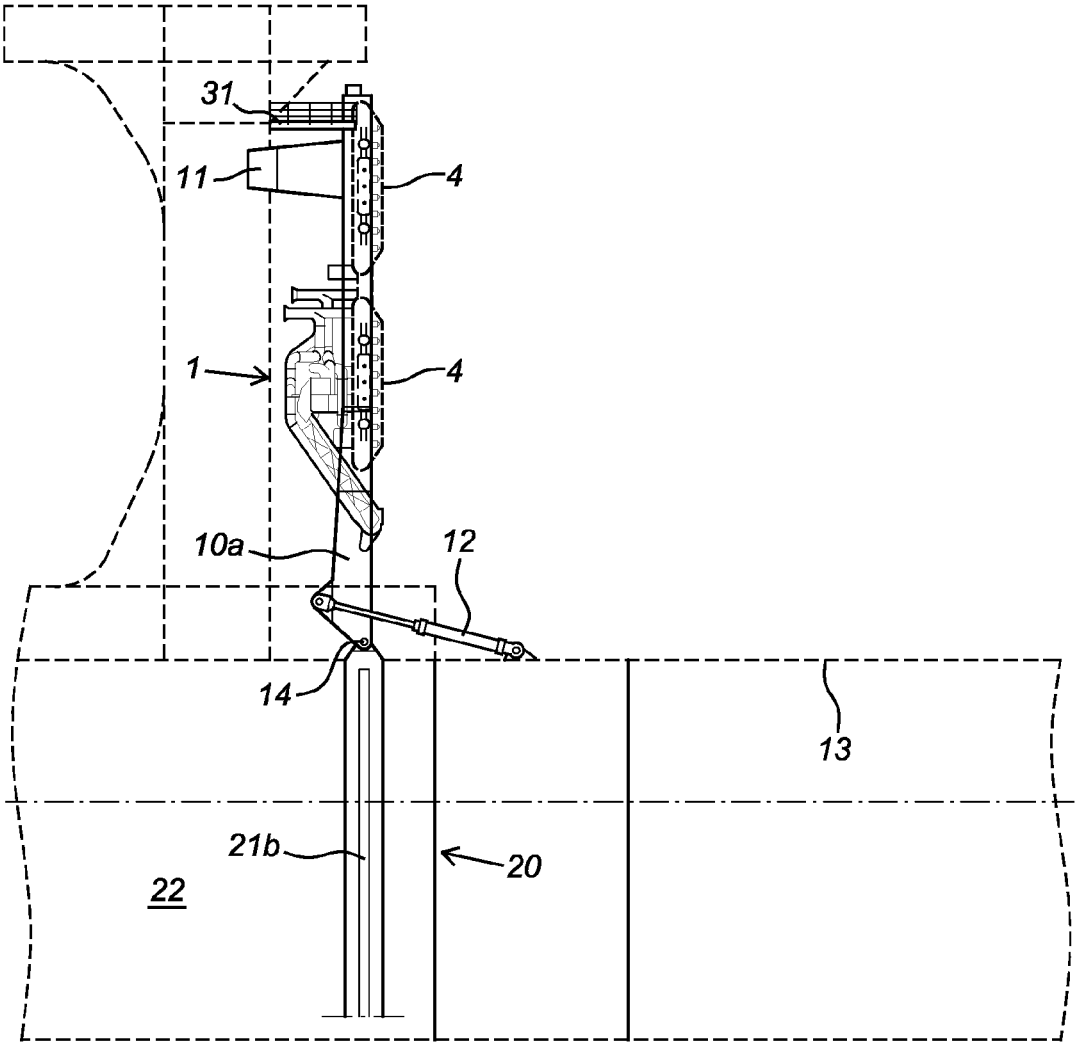

Up-ending of the vehicle is performed first, as shown in FIGS. 6A, 6B and 6C. A skidding mechanism (not shown) transports the vehicle 1 from a storage location on deck of the vessel to a launching area. The upending frame 10 is then lowered on the vehicle 1, and the guiding brackets 8 engaged in the rails (15*a*, 15*b*). Once the guiding brackets 8 are in the rails (15*a*, 15*b*), the vehicle 1 is moved slightly forward (i.e. in the direction of the moon pool 20) and locked to the upending frame 10 by locking cylinders. The hydraulic system is then activated and the frame 10 is upended (FIGS. 4 and 6C).

The vehicle 1 is then connected to the hoisting system 30, as shown in FIG. 5. Once the vehicle 1 is in the vertical position, the two lifting wires 33, the flexible submarine hose assembly 7 and an umbilical wire are connected to the hoisting point 60 of the vehicle lifting frame 6. This may be performed manually on a platform 31 above (at about 40 m for instance) the vessel main deck 13. Once the vehicle 1 is connected and the lifting wires 33 are tensioned, locking cylinders inside the upending frame 10 are retracted. The weight of the vehicle 1 is now suspended in the lifting wires 33.

Figure 6D:
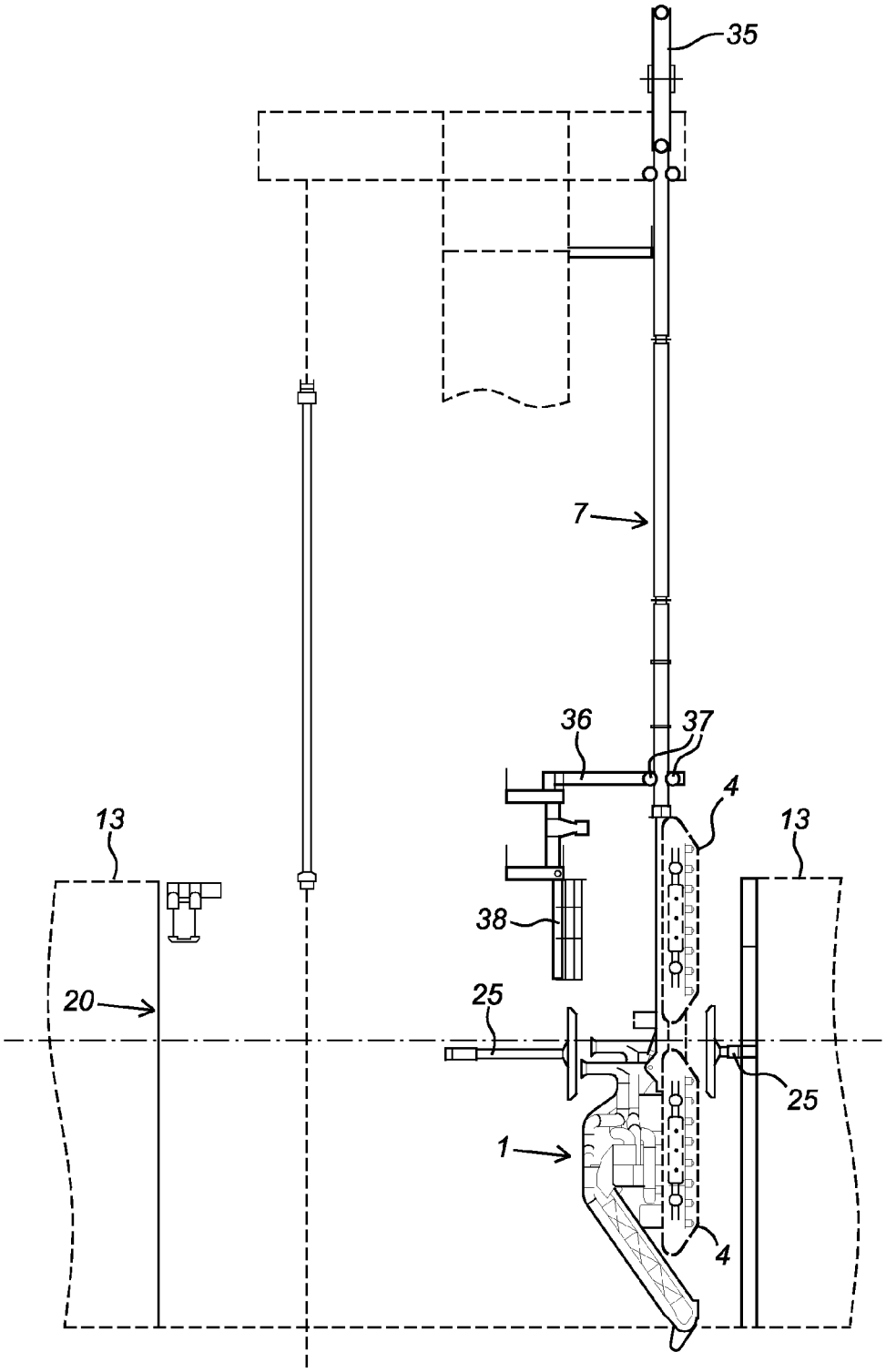

The vehicle 1 is then lowered from the lifting wires 33 whereby the guiding brackets 8 engage in the first engaging means in the form of rails (15*a*, 15*b*) and subsequently in the second engaging means in the form of guiding rails (21*a*, 21*b*), provided in the docking well or moon pool 20. During lowering, the flexible hose assembly 7 and umbilical wires are reeled off. While in the docking well 20, the vehicle 1 is already subjected to significant splash and wave loads. Third engaging means in the form of guiding arms 25 are kept completely open to allow the collector 2 of the vehicle 1 to pass without making contact. In this open position, the arms 25 are kept in a retracted position relative to the docking well 20, as shown in FIG. 6D. Please note that the upending frame 10 is not visible in all FIGS. 6D to 6M, since these figures show cross-sections in a mid-plane of the frame 10.

After being lowered over some distance (about 25 m for instance) arms 36 provided with guide rollers 37 are brought in engagement with flexible hose assembly 7. The front (lower) end of the collector 2 of the vehicle 1 is now almost level with the vessel baseline 17.

Figure 6E:
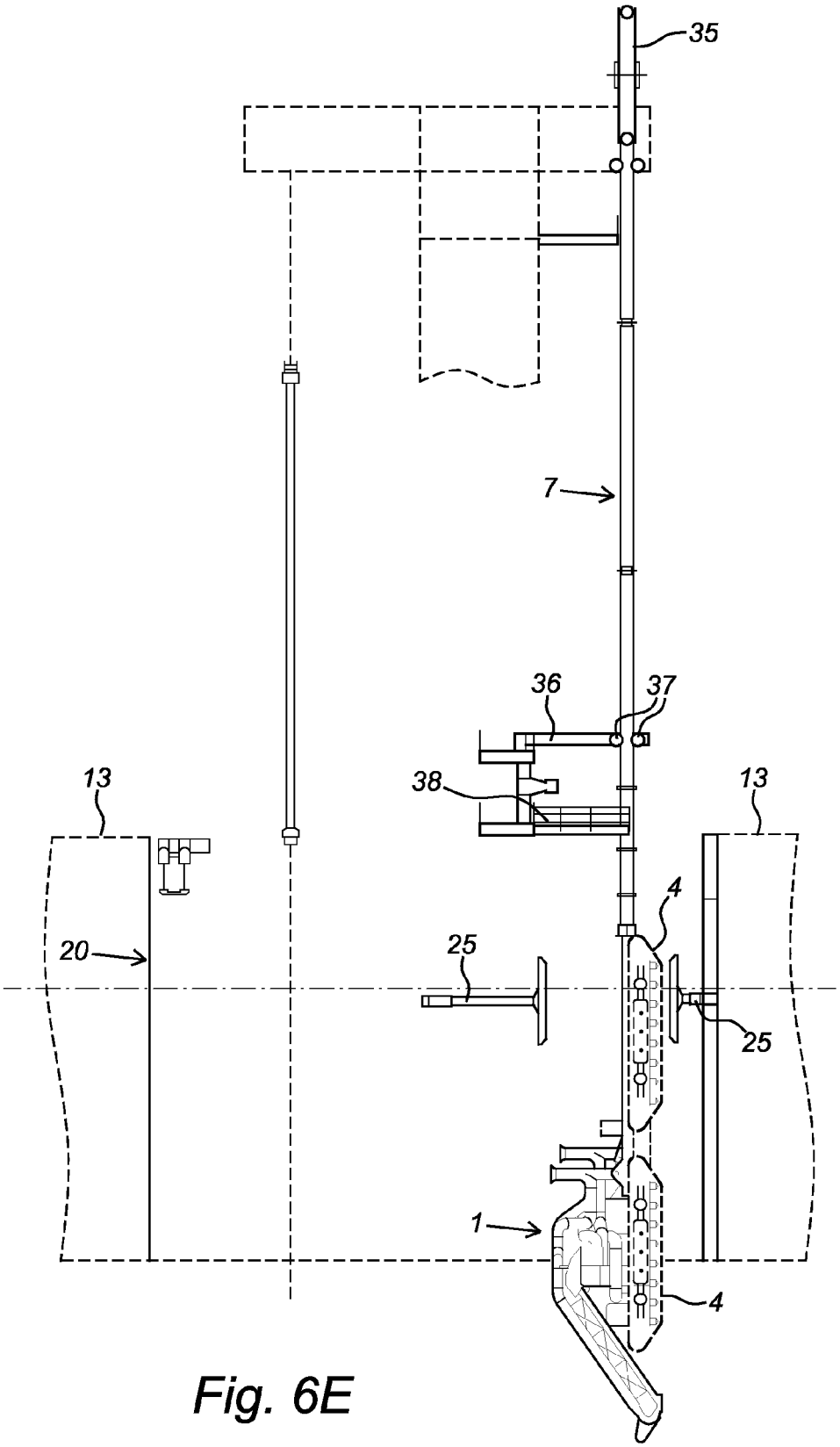
Figure 6F:
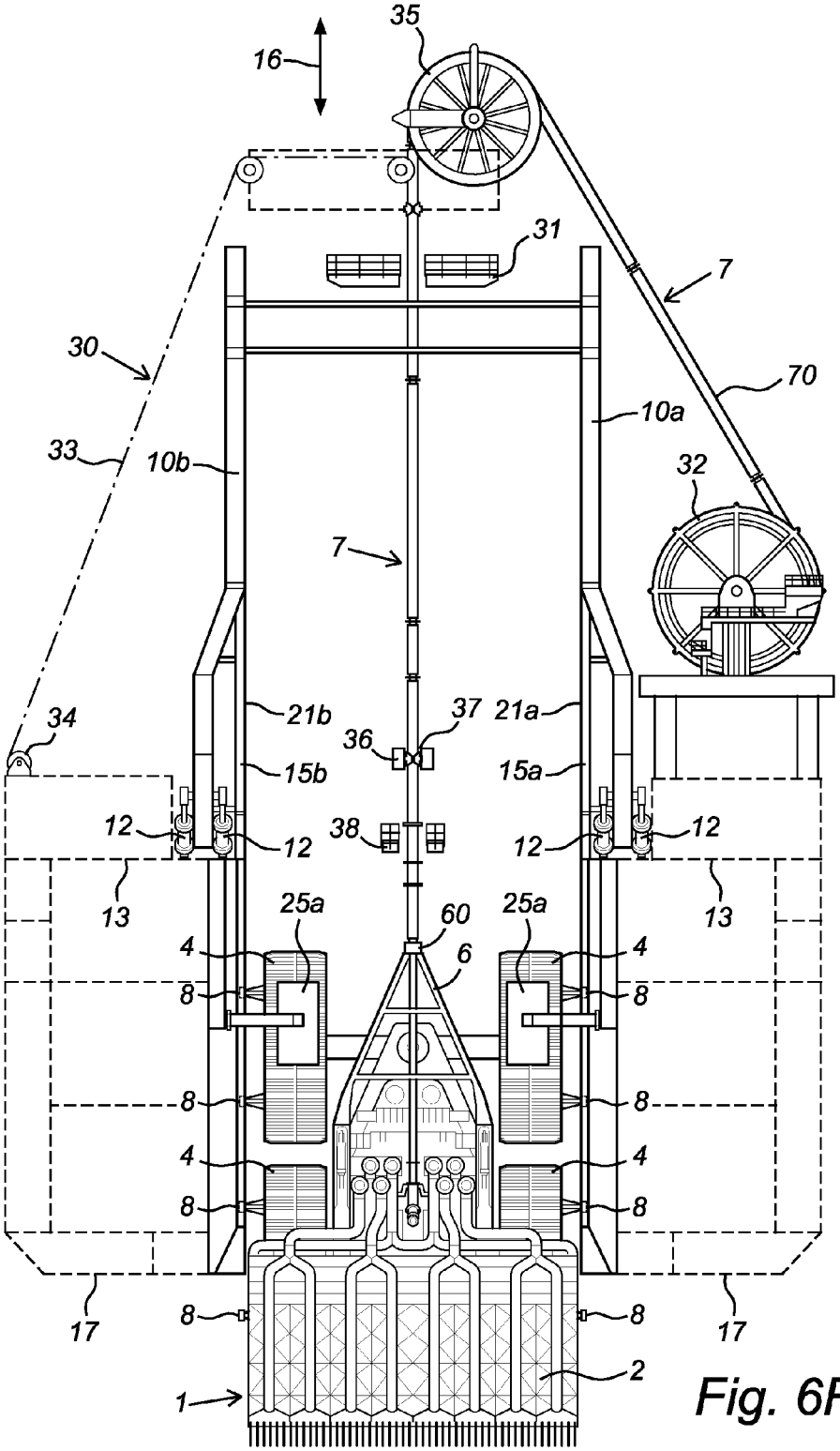

A clamp and buoyancy handling platform 38 may then be installed, as shown in FIGS. 6E and 6F (FIG. 6D shows the platform 38 in a rest position). To this end, the vehicle 1 is lowered an additional distance (8 m for instance) until the hoisting frame 6 is situated below a lowest point of the clamp and buoyancy handling platform 38. The two most forward guiding brackets 8 of the forward track assembly 4 are now located below the guiding rails (21*a*, 21*b*), and the vehicle is held in position by some of the guiding brackets (6 out of 8 for instance, as shown). As the vehicle 1 goes down into the water and further below the vessel baseline 17, the force on the brackets 8 that still engage with the rails (21*a*, 21*b*) increase because the surface of the vehicle 1 that is exposed to the current increases. During deployment of the vehicle 1, the mining vessel preferably drifts along with the current, or has a small relative forward speed.

The buoyancy handling platform 38 is now moved to its working position (FIGS. 6E, 6F) and a first cable clamp (not shown) is installed. From now on, one clamp is installed each time the vehicle is lowered over a certain distance (of 3 m for instance), four per hose section for instance.

Figure 6G:
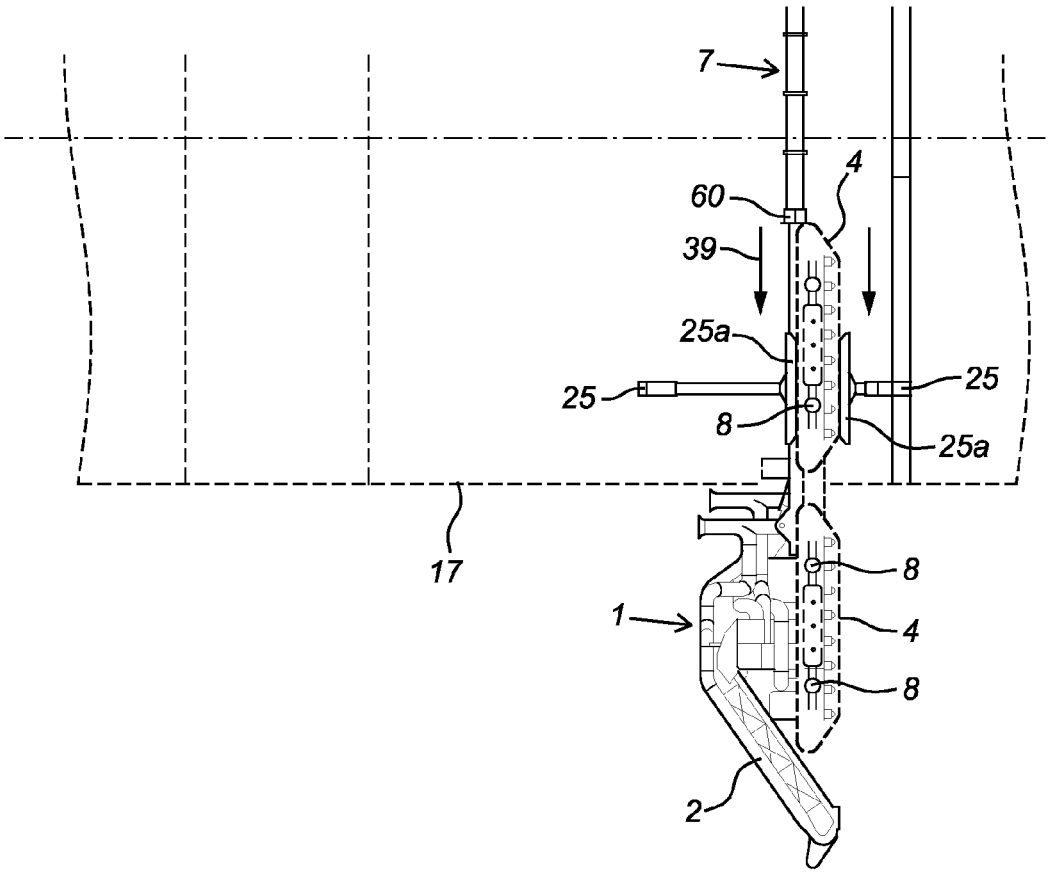
Figure 6H:
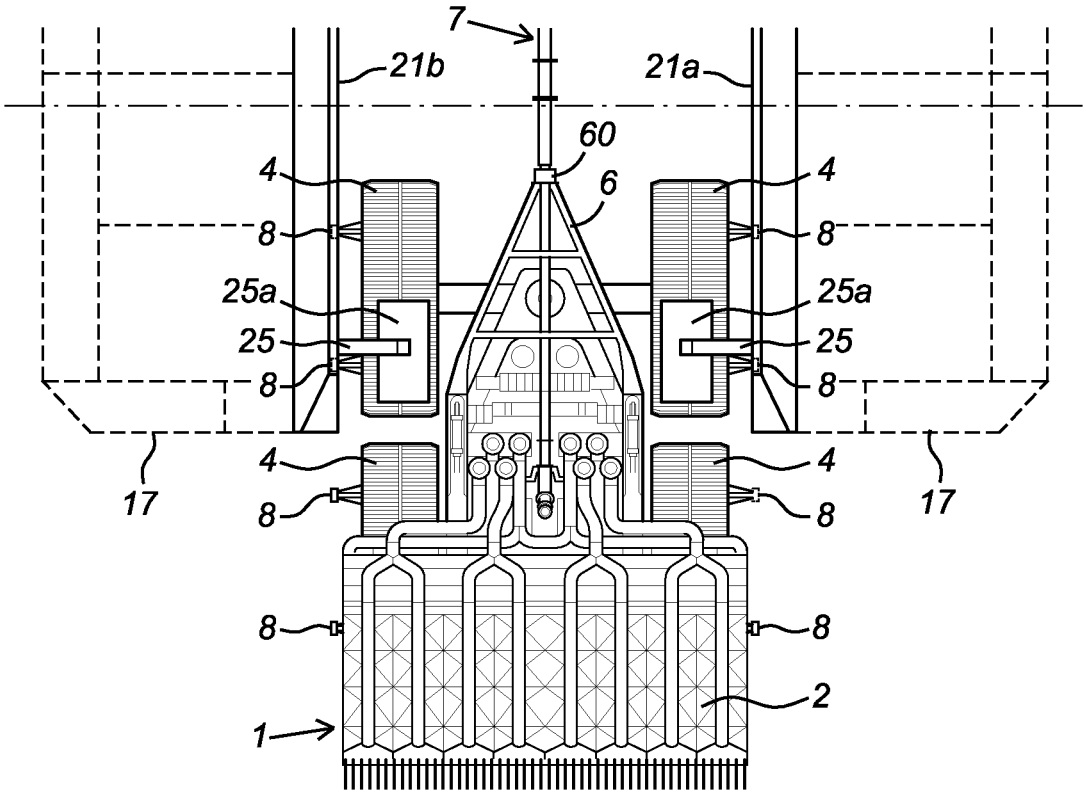

The vehicle 1 is lowered further until a forward part thereof is located below the vessel, for instance over an additional 8 m. In this position, the guiding brackets 8 of the forward track assembly 4 have been freed from the guiding rails (21*a*, 21*b*), as shown in FIGS. 6G and 6H. The most forward guiding brackets 8 of the aft track assembly 4 are now preferably located just above the lowest end of the docking well guiding rails (21*a*, 21*b*). The vehicle 1 is still rigidly connected with the vessel through the guiding brackets 8 of the aft track assembly 4.

The guiding arms 25 are now moved from a retracted position shown in FIGS. 6D and 6E towards a front part of the aft track assembly 4 until they engage said part of the aft track assembly 4, as shown in FIG. 6G. The height of the retracted position of the guiding arms 25 corresponds substantially to the current height of the forward part of the aft track assembly 4, in particular to the height of the forward guiding brackets 8 of the aft track assembly 4. The guiding arms 25 are at ends thereof provided with pressure pads 25*a* that are pressed onto the aft vehicle tracks 4 at the height of the forward brackets 8 thereof and with a limited force, which force is sufficiently high to be able to hold the vehicle 1 in position. The guiding arms 25 further are connected to the vessel such that they may be moved up and down in a vertical direction 39 beyond the vessel's baseline 17. This allows lowering the guiding arms 25 further along with the engaged vehicle 1.

Figure 6I:
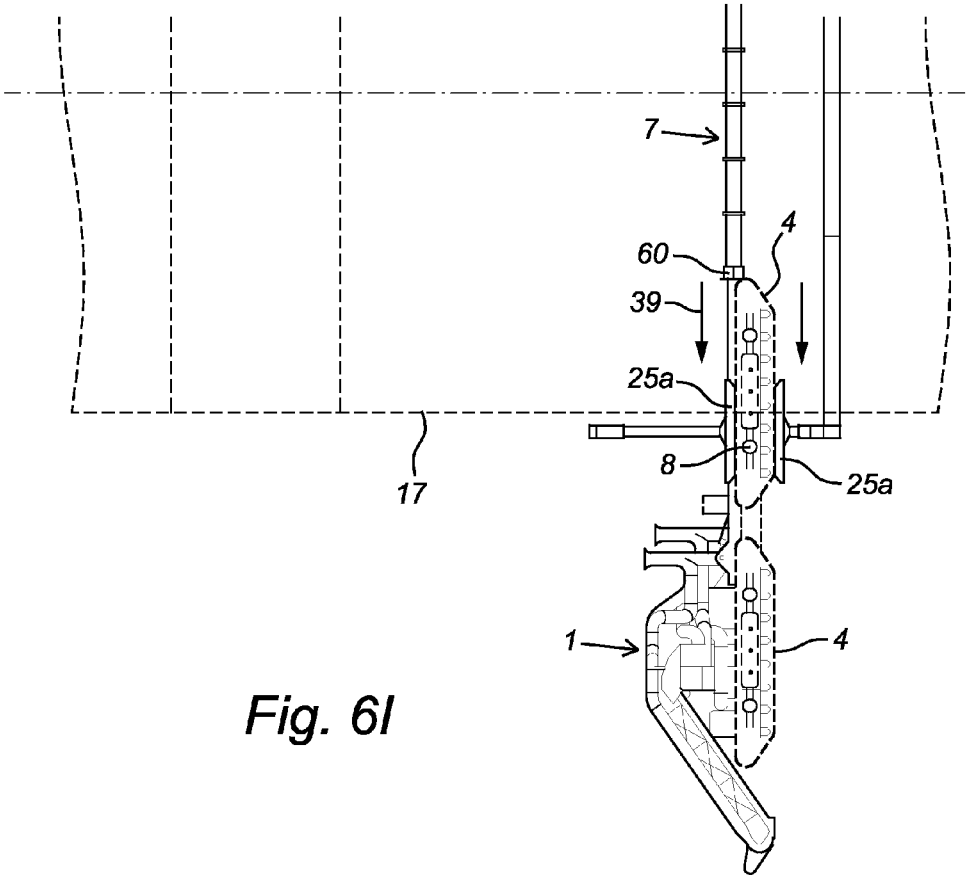
Figure 6J:
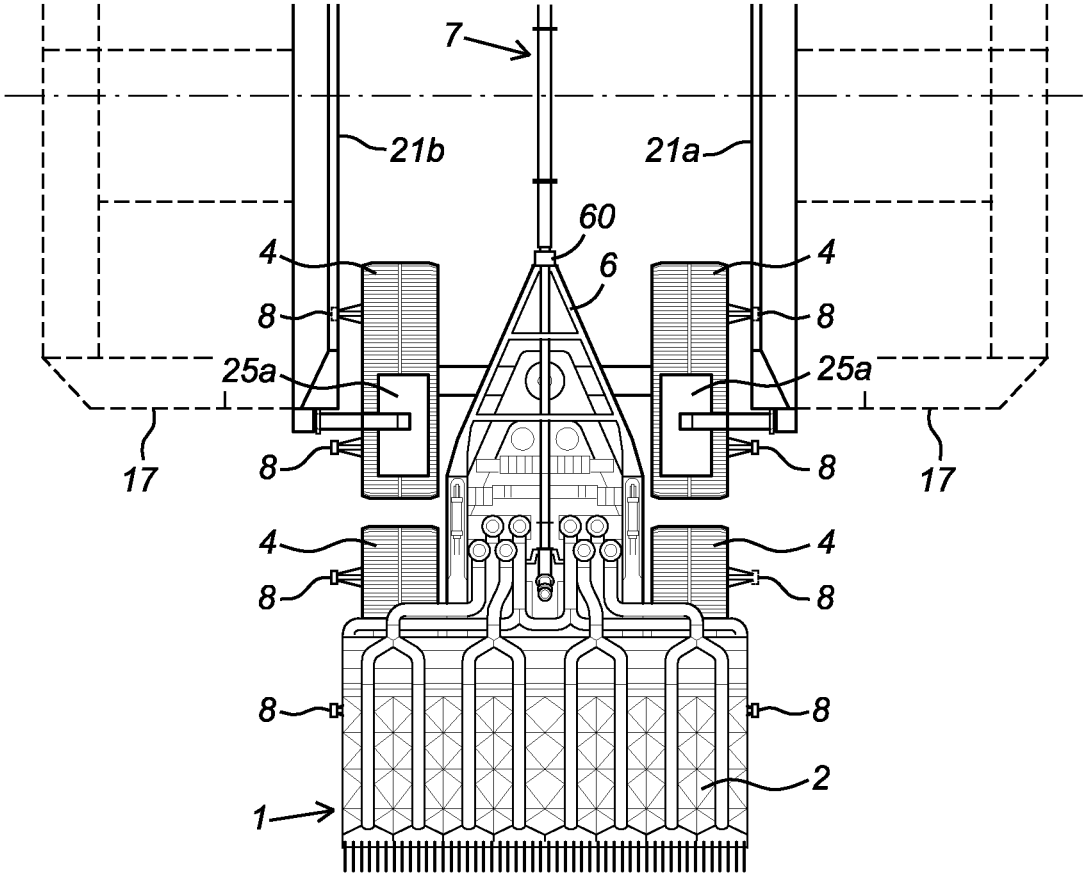

The vehicle 1 is further lowered along with the guiding arms 25 over some distance (about 4.5 m for instance) until the aft brackets 8 of the aft track assembly 4 are located just above the lowest end of the docking well guiding rails (21*a*, 21*b*), as shown in FIGS. 6I and 6J. In this position, the vehicle 1 engages the guiding rails (21*a*, 21*b*) of the docking well 20 with one pair of aft brackets 8 only. The moment exerted by the current force around these aft guiding brackets 8 is now substantially taken up by the guiding arms 25, and the vehicle 1 remains in a substantially vertical position relative to the vessel. The guiding arms 25 (and at least a part of the pads 25*a*) in this position extend beyond the baseline 17 of the vessel.

The guiding arms 25 are now opened (retracted in a horizontal direction) and the vessel master may ensure that a very small positive current of the vessel relative to the vehicle 1 occurs to let the vehicle 1 turn around a horizontal axis and around the aft guiding brackets 8 (that are still in the rails (21*a*, 21*b*)) of the aft track assembly 4 in the direction of the aft side of the vessel. The guiding arms 25 are subsequently released and moved upward to position them at about the same height level as the aft guiding brackets 8 of the aft track assembly 4. The aft guiding arms 25 in this height position are again brought forward until the pressure pads 25 contact the vehicle aft track assembly 4 at the height of the aft guiding brackets 8, as shown in FIG. 6K. Since the pads 25*a* are preferably able to rotate around a horizontal axis, the pads 25*a* will in this embodiment adopt the same angle as the angle of the vehicle tracks 4 relative to a vertical direction.

The vehicle 1 is then lowered over another distance (5 m for instance) along with the guiding arms 25 until the upper most part of the vehicle 1 (the most aft part) is some distance (about 1 m for instance) below the vessel base line 17, at which point all guiding brackets 8 are located completely outside of the docking well rails (21*a*, 21*b*). In this position, shown in FIG. 6L, the guiding arms 25 take up a limited moment only, and the vehicle 1 is substantially free to rotate around a horizontal axis under the action of the current forces. The guiding arms 25 in this embodiment however do take a substantial part of the linear forces exerted by the current.

Figure 6M:
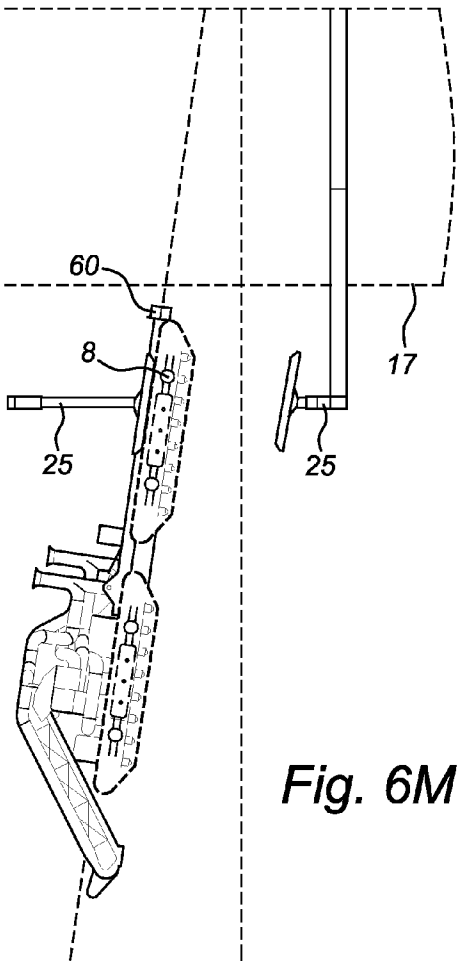
Figure 6L:
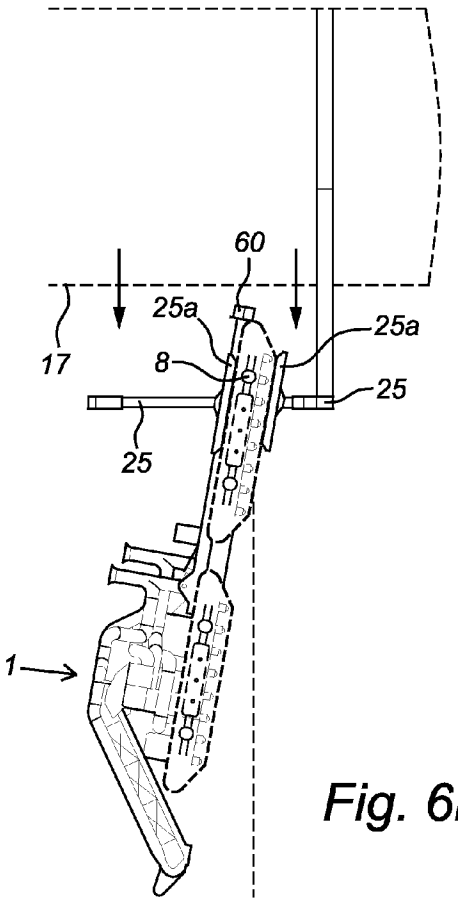
Figure 6K:
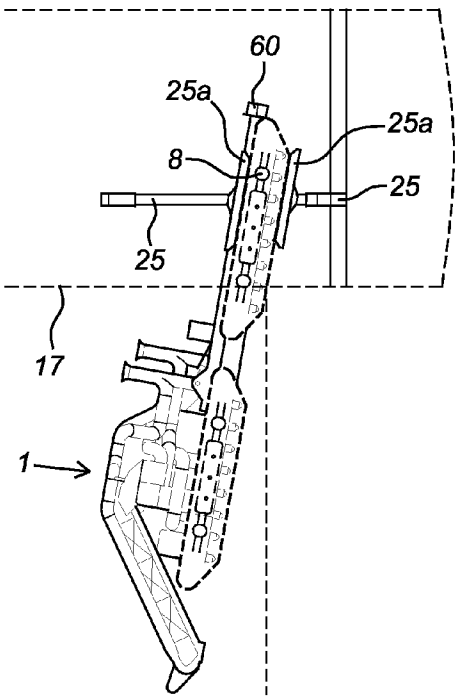

As shown in FIG. 6M, the guiding arms 25 are then slowly retracted to free the vehicle 1 and allow it to find a new equilibrium position without sudden or uncontrolled movements. As the areal surface exposed to the current may be increased, the force acting on the vehicle 1 may increase as well and an equilibrium position at a non-zero tilt angle such as 7.5° for instance will ensue. At this stage, the vehicle 1 is freed from the vessel and is only connected to and suspended from the lifting cables 33 (not shown in FIGS. 6K to 6M).

The guiding arms 25 are now brought upwards inside the docking well 20. At this point there is no more risk of collision of the vehicle 1 with the vessel, and the vehicle 1 had been lowered over a distance of about 30 m below the vessels' baseline 17 for instance. While being lowered until the lifting frame 6 is a distance (50 m for instance) below the buoyancy handling platform 38, the lifting 33 and umbilical wires are attached to the flexible hose 70 by cable clamps.

From this point on, cable clamps are replaced by buoyancy blocks (not shown). These may be installed using a buoyancy block handling system, and a total of 24 blocks is installed over a length of four hoses or about 50 m in a typical embodiment.

When all buoyancy blocks have been installed, the remaining length of hose and wires will be assembled using clamps. After having deployed the interconnecting hose assembly 7 completely, a travelling crane (not shown) is moved to the vehicle 1 launching side. The actuated arms on the travelling crane then 'grab' the interconnecting assembly 7 and the vehicle 1 is subsequently lowered such that the substantially total load of the mining vehicle 1 and interconnecting assembly 7 is taken by the travelling crane. After the load has been transferred to the travelling crane, the (dummy part of the) lifting wires 33 and hose 70 slackens and may be disconnected, for instance manually from the buoyancy platform 38 at main deck level 13.

The travelling crane in an embodiment then transports the vehicle 1 and interconnection hose assembly 7 from the vehicle launching side of the docking well 20 to a riser side of the docking well 20. A riser handling system is prepared in order to ready a first pipe section for installation. The first section is lowered onto the travelling crane and connected to the riser. The first umbilical may be connected to the umbilical that is part of the interconnection hose assembly. Once connected, the hoist of the riser handling system takes the weight, and the travelling crane is moved back to its starting position at the back end of the docking well.

The docking device in accordance with the invention mechanically guides the vehicle through the substantially complete launch (and/or recovery) operation. Since the vehicle is connected to the vessel in a substantially rigid fashion by the device during the launching and recovery procedure, uncontrolled motions of any of the vehicle 1 or any other component are prevented to a large extent.

The invention claimed is:

1. A device for launching a subsurface mining vehicle into a water mass from a docking well of a floating vessel and/or recovering said vehicle from the water mass, the device comprising a docking frame, located at a side of the docking well and a hinge mounted to the vessel, which docking frame comprises first engaging means for guiding the mining vehicle along a longitudinal direction of the frame, and which docking frame operatively engages with drive means for tilting the frame in a vertical plane between a substantially horizontal mining vehicle docking position and a substantially vertical mining vehicle launching or recovery position; the device further comprising third engaging means for guiding the mining vehicle when the vehicle extends at least partly underneath a base of the vessel.

2. The device according to claim 1, wherein the docking well comprises second engaging means for guiding the mining vehicle, the second engaging means connecting to the first engaging means when the frame is in the substantially vertical mining vehicle launching or recovery position.

3. The device according to claim 2, wherein the second engaging means extend along a side wall of the docking well.

4. The device according to claim 2, wherein the first and second engaging means comprise guiding rails, adapted to cooperate with guiding brackets provided on the mining vehicle.

5. The device according to claim 1, wherein the third engaging means are translatable in a vertical direction along the docking well.

6. The device according to claim 1, wherein the third engaging means comprise a plurality of arms that extend in the docking well in a substantially horizontal direction, and are translatable in said horizontal direction.

7. The device according to claim 6, wherein the third engaging means comprise pads adapted to engage with the mining vehicle.

8. The device according to claim 1, wherein the docking frame comprises a pair of parallel docking legs.

9. The device according to claim 1, comprising locking means for securing the frame in an angular position.

10. The device according to claim 1, wherein the drive means comprise hydraulic drive means mounted on the vessel and mechanically linked to the frame.

11. An assembly comprising a device according to claim 1 and a subsurface mining vehicle in engagement with the docking frame.

12. The assembly according to claim 11, wherein the mining vehicle is adapted to mine an underwater bottom in a substantially horizontal position, and the mining vehicle connects with the docking frame in its docking position in the substantially horizontal position of the mining vehicle.

13. The assembly according to claim 11, wherein the mining vehicle is adapted to mine an underwater bottom in a substantially horizontal position, and the mining vehicle connects to the docking frame in its launching or recovery position in a substantially vertical position of the mining vehicle.

14. A method for launching subsurface mining vehicle into a water mass from a docking well of a floating vessel, the method comprising:

providing a device in accordance with claim 1, connecting a mining vehicle to the docking frame in a substantially horizontal docking position of the frame, tilting the frame in a vertical plane between the docking position and a substantially vertical mining vehicle launching position, and lowering the mining vehicle while guiding the mining vehicle along a longitudinal direction of the frame into the water, whereby the mining vehicle is guided by the third engaging means when the vehicle extends at least partly underneath a base of the vessel.

15. A method for recovery of a subsurface mining vehicle from a water mass into a docking well of a floating vessel, the method comprising:

providing a device in accordance with claim 1, bringing a mining vehicle in the vicinity of the vessel, catching and guiding the mining vehicle by the third engaging means when the vehicle extends at least partly underneath a base of the vessel, providing the docking frame in a substantially vertical position, engaging the vehicle and the docking frame, pulling the vehicle upwards out of the water mass while guiding the vehicle along a longitudinal direction of the frame, and tilting the frame in a vertical plane between the substantially vertical mining vehicle recovery position to a substantially horizontal docking position.

16. The method according to claim 14, wherein the mining vehicle is guided along second engaging means provided in the docking well, the second engaging means connecting to the first engaging means when the frame is in the substantially vertical mining vehicle launching or recovery position.

17. The method according to claim 16, wherein the mining vehicle is guided along second engaging means that extend along a side wall of the docking well.

18. The method according to claim 16, wherein the mining vehicle is guided by guiding brackets provided on the mining vehicle that engage with the first and second engaging means comprising guiding rails.

19. The method according to claim 14, wherein the third engaging means are translated in a vertical direction along the docking well.

20. The method according to claim 14, wherein the third engaging means comprise a plurality of arms that extend in the docking well in a substantially horizontal direction, and the arms are translated in said horizontal direction to engage the mining vehicle.

* * * * *